US006335306B1

(12) United States Patent
Segawa et al.

(10) Patent No.: US 6,335,306 B1
(45) Date of Patent: Jan. 1, 2002

(54) THERMOSENSITIVE RECORDING MATERIAL OF HEAT FIXING TYPE AND METHOD OF FIXING THE SAME

(75) Inventors: Takako Segawa, Machida; Yoshiyuki Takahashi, Tokyo, both of (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 09/286,441

(22) Filed: Apr. 6, 1999

(30) Foreign Application Priority Data

Apr. 7, 1998 (JP) ..... 10-094769
Sep. 9, 1998 (JP) ..... 10-255128
Oct. 6, 1998 (JP) ..... 10-284031

(51) Int. Cl.[7] ..... B41M 5/30
(52) U.S. Cl. ..... 503/201; 503/200; 503/216; 503/226
(58) Field of Search ..... 503/200, 201, 503/205, 216, 217, 224, 226

(56) References Cited

U.S. PATENT DOCUMENTS

| | | | | |
|---|---|---|---|---|
| 3,916,068 A | 10/1975 | Kohmura et al. | ..... | 428/411 |
| 4,888,321 A | 12/1989 | Kawakami et al. | ..... | 503/208 |
| 4,916,111 A | 4/1990 | Yaguchi et al. | ..... | 503/226 |
| 5,256,618 A | 10/1993 | Takahashi et al. | ..... | 503/216 |

FOREIGN PATENT DOCUMENTS

| | | | |
|---|---|---|---|
| EP | 0 186 375 | 7/1986 | |
| EP | 0 260 996 | 3/1988 | |
| EP | 0 462 770 | 12/1991 | |
| EP | 0 512 696 | 11/1992 | |
| EP | 0 664 224 | 7/1995 | |
| JP | 0204391 | * 10/1985 | ..... 503/205 |
| JP | 5-147357 | 6/1993 | |
| JP | 7-214900 | 8/1995 | |
| JP | 8-80668 | 3/1996 | |

* cited by examiner

*Primary Examiner*—Bruce H. Hess
(74) *Attorney, Agent, or Firm*—Oblon, Spivak, McClelland, Maier & Neustadt, P.C.

(57) ABSTRACT

The present invention relates to a thermosensitive recording material of heat fixing type. The thermosensitive recording material comprises, on a sheet substrate, a subbing layer and a thermosensitive color image-forming layer in this order, the thermosensitive color image-forming layer comprising a colorless or light-colored dye precursor and a color-developer which reacts with the dye precursor to color the precursor when the color-developer is heated, the color-developer being selected such that the color image formed has a high solvent resistance after the coloring, and the subbing layer comprising a color developability reducing substance capable of reducing the color-developing function of the color-developer and having a melting point of 40° C. or higher.

According to the present invention, a thermosensitive recording material is provided, which has a good fixing property and particularly an excellent legibility of colored images even after accidental heating. The present invention also provides a method of fixing the thermosensitive recording material by heating it to 40° C. or higher, after the thermal printing thereof.

25 Claims, No Drawings

THERMOSENSITIVE RECORDING MATERIAL OF HEAT FIXING TYPE AND METHOD OF FIXING THE SAME

BACKGROUND OF THE INVENTION

The present invention relates to a thermosensitive recording material of heat fixing type. In particular, the present invention relates to a thermosensitive recording material which, after the thermal printing, is heated to reduce the coloring capability of the unprinted part, so that the contrast between the printed parts and the unprinted parts is kept even when the recording material is then heated at a high temperature, thereby making the reading of the printed images possible.

Conventional thermosensitive recording materials comprise a substrate such as a paper sheet, synthetic paper sheet, or plastic film and a thermosensitive color image-forming layer formed on the surface of the substrate and mainly comprising a coloring substance such as an electron-donative leuco dye, and a color developing substance such as an organic acidic substance, e. g., an electron-accepting phenolic compound. A recording image can be formed by melting and reacting the coloring components by the thermal energy. These thermosensitive recording materials are disclosed in Japanese Patent Publication for Opposition Purpose (hereinafter referred to as "J. P. KOKOKU) Nos. Sho 43-4160, 45-14039 and 48-27736, and are widely employed in practice.

Since the thermosensitive recording materials are advantageous in that the recording apparatus is of compact size, has a relatively low price, and can be easily maintained, they are widely used as information-recording materials for recording outputs of printers used with, for example, computers, facsimile machines, automatic ticket-vending machines, scientific measurement recorders and CRT medical measurement recorders.

However, the thermosensitive recording materials have two serious defects. One of them is that in the conventional dye-forming type thermosensitive recording material in which the thermosensitive color image-forming layer comprises a coloring dye, a color-developing agent and a binder and is formed on a support by coating, the printed images fade or disappear when the printed thermosensitive recording material is kept for a long period of time because the coloring reaction is essentially reversible. This is a problem of the reliability of the printed images. This fading of the printed images is accelerated by exposure to light, high humidity and high temperature atmosphere (no resistance to the environments), and is specifically promoted by contact with chemical substances of the common use such as plasticizers and oils, to such an extent that the faded images cannot be recognized.

Various techniques were developed for the purpose of overcoming this defect. As a technique connected with the present invention, a process wherein a sulfonylurea developer is used as disclosed in Japanese Patent Unexamined Published Application (hereinafter referred to as "J. P. KOKAI") Nos. Hei 5-147357, 5-148220, 5-32061, etc. is particularly effective. The effects of this compound are widely recognized, and the compound is used for thermosensitive recording materials of which a high print legibility is requested.

Another defect of the thermosensitive recording materials is that after recording information, the unprinted parts of the thermosensitive recording materials can be still color image-forming by heating or, in other words, the unprinted parts are not yet fixed. Therefore, even when the reliability and storability of the printed images are improved as described above, the unprinted parts on the white papers are colored to make the recognition of the printed images impossible. A term "reheating" herein indicates an unwilling heating conducted after the recording, and a term "re-coloring" indicates the coloring of the white part of the paper by the reheating.

The reheating might be caused in the daily life by ironing or heating with a microwave oven, or it may be caused by mistake with fires of cigarettes, matches or lighters. The application of the thermal energy to form the printed images with a thermosensitive recording machine intentionally or by mistake is also included by the reheating.

The process for preventing the re-coloring is usually called "fixing". Also in the present invention, the term "fixing" indicates a process conducted for the purpose of preventing the re-coloring.

The fixing is considerably difficult because of the nature of the coloring reaction. The techniques proposed so far regarding this act were as follows: It was tried at first to use an azo compound for the coloring (J. P. Kokai Nos. Sho 61-40192, Sho 63-128981 and Hei 7-88356). In this technique, the fixing is conducted by irradiation with light, taking advantage of a phenomenon that the azo compound is decomposed by the irradiation with light to lose its coupling function. Although this method is advantageous in that the re-coloring of the white paper can be almost completely inhibited after the fixing, considerable care should be taken to prepare the micro capsules the azo compound because azo compound is basically easily decomposed. Further, there is another defect in that the coloring of the azo compound, in particular, the black coloring, of the azo compound tends to be insufficient so that it tends to make the contrast of the printed images vague. Still other defects are that since a photo-fixing method is employed in this system, an UV curable ink cannot be used for the printing and that considerable care should be taken to protect the paper from light before printing. Further, a light source of a very high illuminance is necessitated for the photo-fixing method and, as a result, it becomes difficult to achieve the characteristics of the thermosensitive system such as the reduction in size of the apparatus and freeness from the maintenance. Another problem is that since the thermal fixing method takes a considerable period of time, the total printing speed cannot be easily increased.

In a recently disclosed technique, a combination of an imino compound and an isocyanate compound is used as a base for the coloring, or a combination of an amino compound and an aromatic isocyanate compound is used therefor, and the isocyanate compound in the unprinted parts of the paper is inactivated by heating (J. P. KOKAI Nos. Hei 7-214900 and 8-80668).

These methods are epochal in that the fixing is conducted by heating after the printing. However, according to the contents disclosed therein, the thermosensitive paper must be kept at a high temperature of 100° C. or above for at least several minutes to cause a defect that the total printing velocity is very low. In addition, when the combination of the imino compound and the isocyanate compound is used, the tone of color is limited, and it is thus difficult to color and to fix printed images of various colors.

SUMMARY OF THE INVENTION

The object of the present invention is to provide a thermosensitive recording material of heat fixing type, which has an excellent fixing property and particularly an excellent legibility of colored images after the reheating and which can be fixed by an easy method by solving the above-described problems.

The present inventors have made intensive studies in order to solve the above problems, and have found that, by using the specific color developer in the thermosensitive color image-forming layer and a color developability reducing substance in the subbing layer, the above problems can be solved. The present invention has been completed based on this finding.

Therefore, the present invention relates to a thermosensitive recording material comprising, on a sheet substrate, a subbing layer and a thermosensitive color image-forming layer in this order, said thermosensitive color image-forming layer comprising a colorless or light-colored dye precursor and a color-developer which reacts with said dye precursor to color said precursor when said color-developer is heated, said color-developer is selected such that the color image formed has a high solvent resistance after the coloring, and said subbing layer comprising a color developability reducing substance capable of reducing the color-developing function of said color-developer and having a melting point of 40° C. or higher.

DESCRIPTION OF THE PREFERRED EMBODIMENTS

In the present invention, the thermosensitive color image-forming layer comprises (1) a colorless or light-colored dye precursor and (2) a color-developer which reacts with the dye precursor to color the precursor when the thermosensitive color image-forming layer is heated. The color-developer is selected such that the color image formed has a high solvent resistance after the coloring.

The solvent resistance of the color image is evaluated by the following test.

<Color Developer Test Method>

Thermosensitive recording paper sheet is prepared by a process which will be described below.

(1) Preparation of Dispersion A:

| Component | Amount (parts) |
|---|---|
| 3-di(n-butyl)amino-6-methyl-7-anilinofluoran | 20 |
| 10% Polyvinyl alcohol solution | 10 |
| Water | 70 |

The above-described composition is pulverized with a paint shaker to an average particle diameter of about 1 μm.

(2) Preparation of Dispersion B:

| Component | Amount (parts) |
|---|---|
| Color developer | 10 |
| 10% Polyvinyl alcohol solution | 10 |
| Water | 80 |

The above-described composition is pulverized with a paint shaker to an average particle diameter of not larger than 1 μm.

(3) Preparation of Dispersion C:

| Component | Amount (parts) |
|---|---|
| Di-p-methylbenzyl oxalate (Log P = 3.9) | 30 |
| 10% Polyvinyl alcohol solution | 10 |
| Water | 60 |

The above-described composition is pulverized with a paint shaker to an average particle article diameter of not larger than 1 μm.

(4) Formation of Thermosensitive Color Image-Forming Layer:

A coating liquid is obtained by mixing 60 parts of the dispersion A, 240 parts of the dispersion B, 80 parts of the dispersion C, and 90 parts of 10% aqueous polyvinyl alcohol solution under stirring. The coating liquid thus obtained is applied to the support so that the amount of the coating after drying would be 8.0 g/m$^2$ to form a thermosensitive color image-forming layer, and thereby to obtain a thermosensitive recording paper.

(5) Printing Test:

The sample thus obtained is printed with a coloring tester (THPMD; a product of Ohkura Electric Co., Ltd.) under conditions comprising a printing voltage of 21.7 V and printing pulse of 1.0 ms. The color density of the printed parts is determined with a Macbeth Reflection Color Density Tester RD-914 (a product of Macbeth).

(6) Evaluation of Solvent Resistance

The colored portion of the thermosensitive recording material thus obtained in (5) is coated with dioctyl phthalate or salad oil, which is then removed by wiping with Klinex, followed by leaving it for standing for 0.5 hour and measuring the density of the printed parts is determined with a Macbeth Reflection Color Density Tester RD-914 (a product of Macbeth).

The solvent resistance of the color image formed by using the color developer can be evaluated based on the Macbeth density (hereinafter referred to as "Mdd") of 0.2 or higher, preferably 0.4 or higher according to the Color Developer Test Method as stated above wherein dioctyl phthalate is used. The solvent resistance of the color image formed using the color developer can be evaluated based on the Macbeth density (hereinafter referred to as "Mds") of 0.5 or higher, preferably 0.6 or higher according to the Color Developer Test Method as stated above wherein salad oil is used.

The color developer includes those color developers having a group selected from the group consisting the following groups.

(1) a sulfonylurea group (—$SO_2NHCONH$—);

(2) a sulfonamide group (—$SO_2NH$—);

(3) a urea group (—NHCONH—) or a thiourea group (—NHCSNH—);

(4) a combination of a phenol group and a heteroatom other than oxygen;

(5) a salicylic acid group or its metal salt, and (6) a phenol or salicylic acid group, provided that the color developer has a molecular weight of 1000 or higher.

The preferred color developer includes those color developers containing at least two sulfonylurea groups in a molecule.

The color developers are preferably aromatic compounds having at least two sulfonylurea groups represented by the following formula (III):

(III)

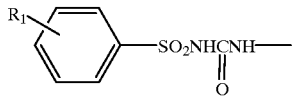

wherein $R_1$ is selected from the group consisting of hydrogen, lower alkyl groups and halogen atoms.

Examples of the color developers include the following compounds: 4,4'-bis(p-toluenesulfonyl aminocarbonyl amino)diphenylmethane (Mdd=1.0), 4,4'-bis(o-toluenesulfonyl aminocarbonyl amino)diphenyl methane (Mdd=1.0), 4,4'-bis(benzenesulfonyl aminocarbonyl amino)

diphenyl methane (Mdd=0.8), 4,4'-bis(1-naphthalenesulfonyl aminocarbonyl amino) diphenyl methane (Mds=0.5), 2,2-bis(4',4"-(p-toluenesulfonyl aminocarbonyl amino)phenyl)propane, 1,2-bis(4'-(p-toluenesulfonyl aminocarbonyl amino)phenyloxy)ethane, 1,3-bis(4'-(p-toluenesulfonyl aminocarbonyl amino) phenyloxy)benzene (Mdd=1.0), 2,5-bis(p-toluenesulfonyl aminocarbonyl aminomethyl)furan, 1,3-bis(p-toluenesulfonyl aminocarbonyl amino)benzene Mds=1.2), 1,4-bis(p-toluenesulfonyl aminocarbonyl amino)benzene (Mds=0.84), 1,5-bis(p-toluenesulfonyl aminocarbonyl amino)naphthalene (Mds=1.05), 1,8-bis(p-toluenesulfonyl aminocarbonyl amino)naphthalene (Mds=0.73), 4,4'-bis(p-toluenesulfonyl aminocarbonyl amino)diphenyl ether (Mdd=1.0), 3,4'-bis(p-toluenesulfonyl aminocarbonyl amino)diphenyl ether (Mdd=0.93), 4,4'-bis(p-toluenesulfonyl aminocarbonyl amino)diphenyl sulfide (Mdd=0.96), 3,3'-bis(p-toluenesulfonyl aminocarbonyl amino)diphenylsulfone Mdd=0.63), 4,4'-bis(p-toluenesulfonyl aminocarbonyl amino)diphenylsulfone (Mdd=0.81) and 1,1,6,6-tetra(p-toluenesulfonyl aminocarbonyl amino)heptane.

In these compounds, 4,4'-bis(p-toluenesulfonyl aminocarbonyl amino)diphenylmethane has particularly preferred properties.

The color developer having a sulfonamide group (—$SO_2$NH—) includes a color developer having a functional group wherein a carbonyl group is directly bonded to a sulfonamide as disclosed in J.P. Kokai Nos. Hei 4-358887 and 4-282291; a color developer having a functional group wherein an amino group is directly bonded to a sulfonamide as disclosed in J.P. Kokai No. Sho 62-238789; a color developer having a sulfonylurea substituent in a molecule as disclosed in J.P. Kokai Nos. Hei 5-32061 and 9-86050; and a color developer having two sulfonamide functional groups in a molecule as disclosed in J.P. Kokai No. Hei 10-297105.

The color developer having a urea group (—NHCONH—) or a thiourea group (—NHCSNH—) includes substituted diphenylurea derivatives as disclosed in J.P. Kokai No. Sho 59-169888; a color developer having two urea functional groups in a molecule as disclosed in J.P. Kokai Nos. Hei 7-164756 and 7-164757; substituted diphenylthiourea derivatives as disclosed in J.P. Kokai Nos. Sho 58-93190, 58-211496 and 59-133096; and a color developer having two thiourea functional groups in a molecule as disclosed in J.P. Kokai No. Hei 7-330652. This color developer specifically includes 3,3'-ditrifluoromethyldiphenylurea, 3,3'-dichlorodiphenylurea and bis-1,4-butene(N'-phenylurea).

The color developer having a phenol group and a heteroatom other than oxygen in a molecule includes dihydroxydiphenylsulfone, p-isopropoxy-p-hydroxydiphenylsulfone as disclosed in J.P. Kokoku No. Sho 63-46067, 2,4-bis(phenylsulfonyl)phenol as disclosed in J.P. Kokai No. Hei 8-269000, a color developer wherein a hydroxy diphenyl sulfone structure is linked by ethylene or ethylene oxide or polyethylene oxide structure, as disclosed in J.P. Kokai No. Hei 8-333329, a color developer having two p-hydroxyphenylsulfonyl groups in a molecule as disclosed in J.P. Kokai No. Hei 1-110815, and a color developer having two p-hydroxyphenylthio groups in a molecule as disclosed in J.P. Kokai No. Hei 5-8546. This color developer specifically includes 1,2-bis(p-hydroxyphenyl sulfonylphenyloxy)ethylene, and 2,2'-bis(p-hydroxyphenyl sulfonylphenyloxy)ethylether.

A color developer having a nitrogen atom as a hetero atom includes those compounds as disclosed in J.P. Kokai Nos. Hei 10-244758, 10-244759 and 10-244760.

A color developer having a phosphorus atom as a hetero atom includes those compounds as disclosed in J.P. Kokai Nos. Hei 3-138195 and 3-182392.

A color developer having a salicylic acid group or its metal salt in a molecule includes salicylic acid derivatives as disclosed in J.P. Kokai Nos. Sho 63-95978, Sho 63-139783 and Hei 4-29886 or the metal salts thereof, and specifically includes 4-(2-(p-methoxyphenyloxy)ethyloxy) salicylic acid, and 4-(2-(p-methoxyphenylsulfony)ethyloxy) salicylic acid.

Examples of the developer having a phenol group or a salicylic group and a high molecular weight of are disclosed in the 76$^{th}$ spring annual meeting of Japan Chemical Society (Proceedings I, 2PB152, pp 618 (1999)).

(V)

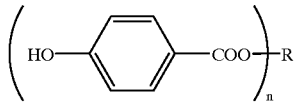

n ≥ 2 R: oligomer residue

These compounds are usable either alone or in the form of a mixture of two or more of them.

The color developer used in the present invention does not include any acidic functional groups such as phenolic hydroxyl group or carboxyl group. However, the sulfonylurea group of the color developer supposedly has a strong interaction with the dye, and also has a strong developing function on basic leuco dyes. Further, this group firmly keeps the once developed dye and inhibits the fading reactions. It is supposed that the strong storability is obtained because two functional groups are contained in the molecule. Thus, even when an oil or fat (or a plasticizer) is brought into contact with a once developed image, the image (printed information) still remains.

On the other hand, when an unprinted part (having no color image formed) is brought into contact with a substance which reduces the color-developing function of the color developer, supposedly, the interaction of these compounds with the color developer is strong and, when the unprinted part is reheated, the coloring to be caused by the reaction of the color developer with the dye is inhibited and the printing and coloring become suppressed.

Color developability reducing substances capable of reducing the color developing function of the color developer and having a melting point of 40° C. or above are used herein. Such a color developability reducing substance is suitably selected from among plasticizers, decolorizers for thermosensitive recording, basic compounds, esters and ethers, which do not reduce the printed image density in the thermosensitively printed part. Preferred color developability reducing substances are aliphatic esters, aromatic esters and basic substances. Among them, the basic compounds are particularly preferred. In the aromatic esters, those which are slowly crystallizable are preferred.

The term "slowly crystallizable aromatic ester compounds" herein indicates organic compounds having at least one aromatic ring and at least one ester group, which can be obtained in the form of crystals after the recrystallization when a suitable solvent is used in the chemical synthesis or purification thereof, however, which are not crystallized when the crystals of these compounds once melt by heating to a melting point or a higher temperature, cooled to a temperature of below the melting point and kept at that temperature for at least 10 minutes.

In the present invention, the thermosensitive color image-forming layer and the subbing layer may also contain a heat-fusible substance. For easy distinction, the heat-fusible substance used in the thermosensitive recording layer will be referred to as "first heat-fusible substance" and that used in the subbing layer will be referred to as "second heat-fusible substance".

The "second heat-fusible substance" has a function of melting together with the color developability reducing substance to lower the melting point of the color developability reducing substance and also of improving the penetration the color developability reducing substance into the thermosensitive color image-forming layer.

A preferred method of fixing the thermosensitive recording material of heat-fixing type which has the above-described structure is as follows: After printing and coloring by a thermosensitive recording apparatus, the recording material is heated to a temperature as low as possible but higher than a temperature at which the color developability reducing substance melts (the melting point per se, or the eutectic point in case where the second heat-fusible substance and the color develop ability reducing substance are present in the same layer to form an eutectic mixture) together with the second heat-fusible substance, and the melt penetrates into the thermosensitive color image-forming layer to interact with the color developer in the thermosensitive color image-forming layer to fix the unprinted parts. Even when the unprinted parts are reheated, they are not easily colored.

On the other hand, the images once colored remain because of a high storability of the so formed images between a dye precursor and the developer used in the present invention.

When the second heat-fusible substance is different from the first heat-fusible substance contained, as so-called sensitizer, in the thermosensitive color image-forming layer and the log P of the second heat-fusible substance is higher than that of the first heat-fusible substance, the recorded images can be read more clearly even after the reheating.

The log P in the present invention is a value determined according to OECD Test, Chemical Test Guideline No. 117, Partition Coefficient; edited by Chemical Product Examination Association). The log P is the logarithm of the partition coefficient P. The higher the value of the partition coefficient, the higher the hydrophobicity; and the lower thereof, the higher the hydrophilicity. When the log P of the second heat-fusible substance is higher than that of the first heat-fusible substance, or in other words, when the hydrophobicity of the former is higher than that of the latter, supposedly the following phenomenon occurs: The second heat-fusible substance melts together with the color developability reducing substance by the fixing operation, and penetrates into the thermosensitive color image-forming layer. However, the second heat-fusible substance hardly penetrates into the color images, because the images are covered and protected by the first heat-fusible compound having a low hydrophobicity in the thermosensitive coloring image-forming layer, and the legibility of the color images is kept high.

The log P value of the second heat-fusible substance is preferably larger by 0.1 to 10, preferably 0.5 to 6, than that of the first heat-fusible substance.

The second heat-fusible substance is usually used in an amount of 5 to 50 wt. %, preferably 10 to 40 wt. % based on the subbing layer.

The heating for the fixing can be conducted by, for example, bringing a hot plate heated to 40° C. or higher, preferably at 50 to 130° C., into contact with the support side, the thermosensitive color image-forming layer side or both sides of the thermosensitive recording material of the fixing type after the printing operation. When the hot plate is brought into contact with both surfaces of the material, the temperatures of the two hot plates may be the same or different from each other. When the temperatures are different, the temperature of the hot plate on the support side is preferably higher than that on the thermosensitive color image-forming layer side. A hot roller heated to 40° C. or higher can be used in place of the hot plate. Two hot rollers can also be used, and the temperatures of these two hot rollers can be made the same or different as described above.

Further, hot bars having a relatively low heat capacity and therefore capable of being rapidly heated can be also used. In this case, hot bars can be arranged along the direction of the recording material moving, or above and below the moving recording material to sandwich this material, or a combination of these two methods can be employed.

A thermal head which generates heat pulse or heat ray such as infrared ray is also usable for the heating.

The thermosensitive recording material is preferably heated to 50° C. or above for 10 seconds or less, much preferably 5 seconds or less. In addition, the time from the recording step to the heating step is preferably 10 seconds or less, much preferably 5 seconds or less.

The subbing layer of the present invention comprises the color developability reducing substance and, if necessary, the second heat-fusible substance which can melt together with the color developability reducing substance to lower the melting point of the color developability reducing substance and also to improve the penetration of the color developability reducing substance into the thermosensitive color image-forming layer. If necessary, a pigment, an adhesive, etc. are also usable.

The color developability reducing substance has preferably a melting point of 50 to 150° C.

The amount of the color developability reducing substance in the subbing layer is preferably 0.5 to 5 parts by weight per part by weight of the color developer in the thermosensitive color image-forming layer. When it-is below 0.5 part by weight, the effect of preventing the re-coloring is insufficient and, on the contrary, when it exceeds 5 parts by weight, the coating property tends to be impaired.

The slowly crystallizable aromatic compounds which can be contained as the color developability reducing substance in the subbing layer in the present invention include, for example, pentaerythritol tetrabenzoate (m. p.: 96° C.), pentaerythritol tetra(m-toluate) (m. p.: 106° C.) and pentaerythritol tetra(o-toluate) (m. p.: 93° C.). The aliphatic ester compounds include, for example, glycerol fatty acid esters such as glycerol tristearate (m. p.: 56° C.), hardened vegetable oils (m. p.: 65–69° C.) and beef tallow (m. p.: 60° C.); propylene glycol fatty acid esters such as propylene glycol behenate (m. p.: 58° C.); higher alcohol fatty acid esters such as stearyl stearate (m. p.: 56° C.) and polyhydric alcohol fatty acid esters (m. p.: 60° C.).

The basic compounds usable herein as the color developability reducing substance include a compound of the following formula (I) (m. p.: 80° C.):

(I)

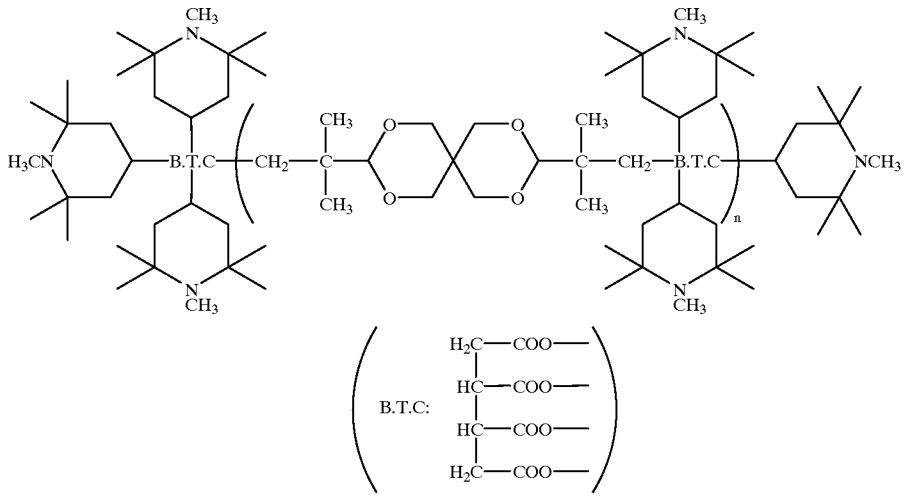

a compound of the following formula (IV) (m. p.: 80° C.):

(IV)

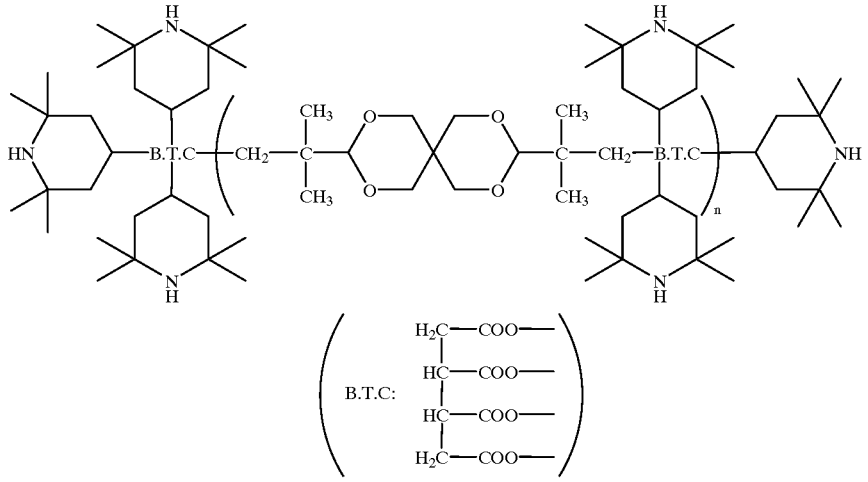

or a compound of the following formula (II) (m. p.: 130–140° C.):

(II)

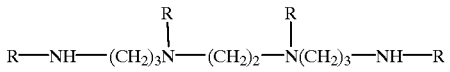

-continued

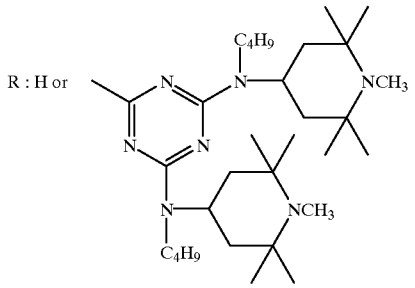

-MW. ≥ 2000-

The basic compounds usable herein include hindered amine compounds such as tetrakis(1,2,2,6,6-pentamethyl-4-piperidinyl)-1,2,3,4-butane tetracarboxylate (m. p.: about 130° C.), bis(2,2,6,6-tetramethyl-4-piperidyl) sebacate (m. p.: 84° C. ); and compounds having an N-methylpiperidine group and tertiary amine such as those having two N-methylpiperidine groups and a tertiary amine (molecular weight: about 550, m. p.: 51° C.) and those having three N-methylpiperidine groups and a tertiary amine (molecular weight: about 700, m. p.: 54° C.).

The compounds most suitable for the subbing layer are basic compounds, particularly compounds of the above formulae (I), (II) and (IV).

These basic compounds are usable either alone or in the form of a combination of two or more of them.

Examples of the second heat-fusible substance to be contained in the subbing layer include phenyl 1-hydroxy-2-naphthoate (log P=5. 1), p-benzylbiphenyl (log P=6.3), benzyl naphthyl ether (log P=5.2), dibenzyl terephthalate (log P=5.7), benzyl p-benzyloxybenzoate, diphenyl carbonate, dinitrile carbonate, m-terphenyl (log P=6.16), 1,2-bis(m-tolyloxy)ethane (log P=5.0), 1,2-bis(3,4-dimethylphenyl)ethane (log P=7.8), 1,5-bis(p-methoxyphenoxy)-3-oxapentane, oxalic acid diesters, dibenzyl oxalate, a mixture of di-p-methylbenzyl oxalate and di-p-chloromethylbenzyl oxalate, di-o-chlorobenzyl adipate (log P=5.8), 1,4-bis(p-tolyloxy)benzene (log P=3.1), phenyl p-toluenesulfonate (m. p. 96° C.), p-tolyl mesitylenesulfonate (m. p.: 100 to 102° C.) (log P=3.1), 4,4'-diallyloxydiphenylsulfone (log P=3.3), methyl 4-ethoxyphenylmethylsulfone (m. p. 91° C.), 4,4'-diisopentyloxydiphenylsulfone (m. p.: 100° C.), 2,2-bis(4-benzenesulfonyloxyphenyl)propane (m. p.: 114° C.), 2,2-bis (4-methanesulfonyloxyphenyl)propane (m. p.: 101° C. ), N-phenyl-4-methylphenylsulfonamide (m. p.: 102° C.), o-chloroacetoacetoanilide (m. p.: 103° C. ) (log P=0.2), p-methoxybenzene acetoacetoanilide, N-benzyl-o-sulfophthalimide and 1-phenoxy-2-β-naphthoxyethane (log P=5.2).

Examples of the leuco dye precursors in the present invention include triphenylmethane compounds, fluoran compounds and diphenylmethane compounds.

They include, for example, 3-(4-diethylamino-2-ethoxyphenyl)-3-(1-ethyl-2-methyl indole-3-yl)-4-azaphthalide, Crystal -Volet Lactone, 3-(N-ethyl-N-isopentyl amino)-6-methyl-7-anilinofluoran, 3-diethylamino-6-methyl-7-anilinofluoran, 3-diethyl amino-6-methyl-7-(o,p-dimethyl anilino)fluoran, 3-(N-ethyl-N-p-toluidino)-6-methyl-7-anilinofluoran, 3-pyrrolidino-6-methyl-7-anilinofluoran, 3-dibutyl amino-6-methyl-7-anilinofluoran, 3-(N-cyclohexyl-N-methyl amino)-6-methyl-7-anilinofluoran, 3-diethyl amino-7-(o-chloroanilino)fluoran, 3-di(n-butyl)amino-7-(o-chloroanilino)fluoran, 3-di(n-butyl)amino-6-methyll-7-anilino fluoran, 3-diethyl amino-7-(m-trifluoromethyl anilino)fluoran, 3-diethyl amino-6-methyl-7-chlorofluoran, 3-diethyl amino-6-methylfluoran, 3-cyclohexyl amino-6-chlorofluoran, 3-(N-ethyl-N-hexyl amino)-6-methyl-7-(p-chloroanilino)fluoran, 2-chloro-3-methyl-6-(N,N-diethyl aminoanilino)fluoran, 3-(p-anilinoanilino)-6-methyl-7-anilinofluoran, 3,6-bis(dimethyl amino)fluorene-9-spiro-3'-(6'-dimethyl aminophthaiide), 3,3-bis(2-(p-dimethyl aminophenyl)-2-(p-methoxyphenyl)ethenyl)-4,5,6,7-tetrachlorophthalide, bis(p-dimethyl aminostyryl)-p-toluene sulfonyl methane and 2,2-bis(4-(6'-(N-cyclohexyl-N-methyl amino)-3'-methylspiro(phthalido-3,9'-xanthene)-2'-ylamino)phenyl)propane. Among them, 2,2-bis(4-(6'-N-cyclohexyl-N-methyl amino)-3'-methylspiro(phthalido-3,9'-xanthene)-2'-ylamino)phenyl)propane has particularly preferred properties.

They are usable either alone or in the form of a mixture of two or more of them.

The color developers used in the present invention are usable in combination with color developers known in the art such as sulfonylurea compounds and phenolic compounds.

The known color developers are, for example, N-(p-toluenesulfonyl)-N'-phenylurea, N-(p-toluenesulfonyl)-N'-(p-methoxyphenyl)urea, N-(p-toluenesulfonyl)-N'-(o-tolyl) urea, N-(p-toluenesulfonyl)-N'-(m-tolyl)urea, N-(p-toluenesulfonyl)-N'-(p-tolyl)urea, N-(p-chlorobenzene sulfonyl)-N'-phenylurea, N-(p-toluene sulfonyl)-N-(o-chlorophenyl)urea and N-(benzene sulfonyl)-N'-phenylurea (color developers disclosed in J. P. KOKAI No. Hei 5-32061); 2,2-bis(4-hydroxyphenyl)propane (bisphenol A), 1,1-bis(4-hydroxyphenyl)-1-phenylethane, 1,4-bis(1-methyl-1-(4'-hydroxyphenyl)ethyl)benzene, 1,3-bis(1-methyl-1-(4'-hydroxyphenyl)ethyl)benzene and dihydroxydiphenyl ether (disclosed in J. P. KOKAI No. Hei 1-180382), benzyl p-hydroxybenzoate (J. P. KOKAI No. Sho 52-140483); bisphenol S and 4-hydroxy-4'-isopropyloxydiphenylsulfone (J. P. KOKAI No. Sho 60-13852); 1,1-di(4-hydroxyphenyl)cyclohexane and 1,7-di (4-hydroxyphenylthio)-3,5-dioxaheptane (J. P. KOKAI No. Sho 59-52694); and 3,3'-diallyl-4,4'-dihydroxydiphenylsulfone (J. R KOKAI No. Sho 60-208286).

These compounds are usable either alone or in the form of a combination of two or more of them.

The thermosensitive color image-forming layer of the present invention may contain a first heat-fusible substance, in order to improve sensitivity. The first heat-fusible substance may be the same as or different from the second heat-fusible substance.

The first heat-fusible substance includes, for example, the following materials: phenyl 1-hydroxy-2-naphthoate (log P=5.1) (J. P. KOKAI No. Sho 57-191089), benzyl naphthyl ether (log P=5.2) (J. P. KOKAI No. Sho 58-87094), dibenzyl terephthalate (log P=5.7) (J. P. KOKAI No. Sho 58-98285), benzyl p-benzyloxybenzoate (J. P. KOKAI No. Sho 57-201691), diphenyl carbonate, ditolyl carbonate (J. P. KOKAI No. Sho 58-136489), 1,2-diphenoxyethane (log P=3.6), 1,2-bis(m-tolyloxy)ethane (log P=5.0) (J. P. KOKAI No. Sho 60-56588), 1,5-bis(p-methoxyphenoxy)-3-oxapentane (J. P. KOKAI No. Sho 62-181183), bis(2-(4-methoxyphenoxy)ethyl) ether (log P=2.9) and oxalic acid diesters [J. P. KOKAI No. Sho 64-1583, and J. P. KOKOKU No. Hei 5-62597], dibenzyl oxalate (log P=3.1), di-p-methylbenzyl oxalate (log P=4.3), a mixture of di-p-methylbenzyl oxalate and di-p-chloromethylbenzyl oxalate, 1,4-bis(p-tolyloxy)benzene (J. P. KOKAI No. Hei 2-153783), diphenylsulfone (log P=1.5) (m. p.: 124° C.), phenyl p-toluenesulfonate (log P=3.1) (m. p.: 96° C.), p-tolyl mesitylenesulfonate (m. p.: 100 to 102° C.), 4,4'-diallyloxydiphenyl sulfone (log P=3.3) (m. p.: 145° C.), 4-ethoxyphenylmethyl sulfone (m. p. 91° C.), 4,4'-diisopentyloxy diphenyl sulfone (m. p.: 100° C.), 4,4'-dimethoxydiphenyl sulfone (m. p.: 130° C.), (2,2-bis(4-benzene sulfonyloxy phenyl)propane (m. p.: 114° C.), 2,2-bis(4-methane sulfonyloxy phenyl)propane (m. p.: 101° C.), N-phenyl-4-methylphenylsulfonamide (m. p.: 102° C.), o-chloroacetoacetoanilide (m. p.: 103° C.), p-methoxybenzene acetoacetoanilide, N-benzyl-o-sulfophthalimide and 1-phenoxy-2-β-naphthoxyethane (m. p.: 137° C.).

The thermosensitive color image-forming layer of the present invention may further contain a hindered phenol compound, an ultraviolet ray-absorber, etc. They are compounds described in, for example, J. P. KOKAI Nos. Sho 57-151394, Sho 58-160191, Sho 58-69096, Sho 59-2884, Sho 59-95190, Sho 60-22288, Sho 60-255485, Sho 61-44686, Sho 62-169683, Sho 63-17081, Hei 1-249385 and Hei 2-266645.

Examples of them are 2-(2'-hydroxy-5'-methylphenyl) benzotriazole, 2,4-dihydroxybenzophenone, 2-(2'-hydroxy-3'-tert-butyl-5'-methylphenyl)-5-chlorobenzotriazole and 2-(2'-hydroxy-3',5'-di-tert-butylphenyl)-5-chlorobenzotriazole.

The thermosensitive color image-forming layer of the present invention mainly comprises the leuco dye precursor and the color developer having at least two sulfonylurea groups. The thermosensitive color image-forming layer may further contain, if necessary, a sensitizing agent, a color developer which is a well-known phenolic, sulfonylurea or organic acid, an antioxidant, a U. V. absorber or a wax. This layer preferably contains an organic or inorganic pigment. This layer further contains a binder for fixing these ingredients on the support.

The leuco dye precursor content of the thermosensitive color image-forming layer is preferably 5 to 40% by weight based on the dry weight of the thermosensitive color image-forming layer. The color developer content, which is not particularly limited, is usually preferably 5 to 50% by weight based on the dry weight of the thermosensitive color image-forming layer.

When the antioxidant or ultraviolet absorber is contained in the thermosensitive coupling layer, the amount thereof is preferably 1 to 10% by weight based on the dry weight of the thermosensitive color image-forming layer. When a well-known phenolic or organic acid color developer is also used, the amount thereof is preferably 5 to 40% by weight based on the dry weight of the thermosensitive color image-forming layer. The amount of a sensitizer contained therein is preferably 10 to 40% by weight based on the dry weight of the thermosensitive color image-forming layer. When a wax and a pigment are contained in the thermosensitive color image-forming layer, the amounts thereof are preferably 5 to 20% by weight and 10 to 50% by weight based on the dry weight of the thermosensitive color image-forming layer, respectively. The amount of the binder contained therein is usually 5 to 20% by weight based on the dry weight of the thermosensitive color image-forming layer.

The organic or inorganic pigments include white pigments such as fine, powdery inorganic substances, e. g., calcium carbonate, silica, zinc oxide, titanium oxide, aluminum hydroxide, zinc hydroxide, barium sulfate, clay, calcined clay, talc, and surface-treated calcium carbonate and silica; and fine, powdery organic substances, e.g., urea/formalin resin, styrene/methacrylic acid copolymer and polystyrene resin. When an alkaline earth metal salt such as calcium carbonate is used in a large amount, the sensitivity tends to be lowered and, therefore, such a salt is preferably used in an amount of not larger than 20% by weight based on the dry weight of the thermosensitive color image-forming layer. The pigment in the subbing layer is particularly preferably a fine organic powder having only a low oil absorption.

As the waxes, those well-known in the art are usable. They include, for example, paraffins, amide waxes, bisimide waxes and metal salts of higher fatty acids.

The binders usable herein include those of various molecular weights. They include water-soluble polymeric materials such as polyvinyl alcohol, starch and derivatives thereof, cellulose derivatives, e. g., methoxy cellulose, carboxymethyl cellulose, methyl cellulose and ethyl cellulose, sodium polyacrylate, polyvinyl pyrrolidone, acrylic acid amide/acrylic ester copolymer, acrylic acid amide/acrylic ester/methacrylic acid terpolymer, alkali metal salt of styrene/maleic anhydride copolymer, polyacrylamide, sodium alginate, gelatin and casein; and latexes of, for example, polyvinyl acetate, polyurethane, styrene/butadiene copolymer, polyacrylic acid, polyacrylic esters, vinyl chloride/vinyl acetate copolymer, polybutyl methacrylate, ethylene/vinyl acetate copolymer and styrene/butadiene/acrylic copolymers.

An intermediate layer comprising an oil-absorbing pigment is preferably formed between the subbing layer and the thermosensitive color image-forming layer. The oil absorption of the oil-absorbing pigment is preferably at least 35 ml/100 g, preferably at least 70 ml/100 g as determined according to JIS K 5101.

The intermediate layer inhibits the formation of excess molten components, which are called "smudge on head" (herein after referred to simply "head smudge" or "smudge") in the thermosensitive printing step in the printing.

Another effect of the intermediate layer is to inhibit the migration of the fixing agent into the thermosensitive color image-forming layer in the course of the preparation or storage.

When the subbing layer also contains the heat-fusible substance, smudge tends to be formed in the printing step. The intermediate layer has a function of inhibiting the smudge formation to make the printing operation smooth and to improve the continuous printing property.

The amount of the pigment, which is the main component in the intermediate layer of the present invention, is usually preferably 50 to 95% by weight, particularly 70 to 90% by weight, based on the dry weight of the intermediate layer. The binder content is preferably 5 to 20% by weight based on the dry weight of the intermediate layer.

The pigments contained in the intermediate layer may be either inorganic or organic pigments.

Examples of the organic or inorganic pigments include white pigments such as fine, powdery inorganic substances, e. g. calcium carbonate, silica, zinc oxide, titanium oxide, aluminum hydroxide, zinc hydroxide, barium sulfate, clay, calcined clay, calcined kaolin, kaolin, talc, and surface-treated calcium carbonate and silica; and fine, powdery organic substances (plastic pigments), e. g. urea/formalin resin, styrene/methacrylic acid copolymer and polystyrene resin.

Among them, pigments having an oil absorption of at least 35 ml/100 g as determined according to JIS K 5101 are preferred. Examples of them include calcined kaolin (e. g., Ansilex 93, a product of Engelhard Corporation; oil absorption: 90 ml/100 g), kaolin (e. g., Kaofine, a product of Thiele Kaolin; oil absorption: 40 to 50 ml/100 g), clay (HG clay, a product of Huber; oil absorption: 35 to 50 ml/100 g), calcined clay and silica (e. g., Mizukasil P527, a product of Mizusawa Industrial Chemicals Ltd.; oil absorption: 160 ml/100 g and Mizukasil P603, a product of Mizusawa Industrial Chemicals Ltd.; oil absorption: 120 ml/100 g).

The binders which can be contained in the intermediate layer may be the same as those in the thermosensitive color image-forming layer or different from them. The binders are preferably resistant to water.

The intermediate layer of the present invention mainly comprising the pigment may contain, if necessary, the waxes or a small amount of the heat-fusible organic compounds which can be contained in the thermosensitive coupling layer as described above. The intermediate layer further contains binders for these components.

The sheet support usable for the thermosensitive recording material of the present invention can be selected from among paper sheets (including acid sizing papers and neutral/alkaline sizing papers), fluorine-coated paper sheets (oil-resistant paper sheets), paper sheets coated with a pigment, latex or the like, laminated paper sheets, synthetic paper sheets made of a polyolefin resin and plastic films. The thermosensitive recording material is produced by applying a coating liquid containing a mixture of the above-mentioned necessary components to at least one surface of the sheet support and drying it.

The amount of the coating liquid which is not particularly limited is preferably 1 to 15 g/m$^2$ (in dry state) for forming the thermosensitive color image-forming layer, and preferably 1 to 10 g/m$^2$ (in dry state) for forming the intermediate layer. When the amount of the coating liquid is insufficient, the improvement in the formation of head smudge is impossible. The amount of the coating liquid for forming the subbing layer is preferably 1 to 30 g/m$^2$.

In the thermosensitive recording material of the present invention, a coating layer such as a protective layer or a layer for printing can be formed on the thermosensitive color image-forming layer.

In the present invention, the thermosensitive recording material can be further processed to have further improved functions and thereby to increase the added value thereof. For example, the back surface of this recording material can be processed with a pressure-sensitive adhesive, a rewetting adhesive or a delayed tack-type adhesive to form a pressure-sensitive adhesive paper, a rewetting adhesive paper or a delayed tack paper (this has a merit that when it is heated to make it adhesive, it can be also fixed). Also, by forming a magnetic recording layer on the back surface, a thermosensitive reversible recording material capable of magnetic recording can be obtained. Also, a function as a thermal transfer sheet, an ink jet recording sheet, a non-carbon copying sheet, an electrostatic recording sheet or a xerographic recording sheet may be imparted to the back surface of the thermal recording material.

The following Examples will further illustrate the present invention, wherein parts and percentages are given by weight unless otherwise stated.

EXAMPLE 1

Thermosensitive recording paper sheets were prepared by a process which will be described below.

(1) Preparation of Dispersion A:

| Component | Amount (parts) |
|---|---|
| 2,2-Bis(4-(6'-(N-cyclohexyl-N-methylamino)-3'-methyl-spiro-(phthalido-3,9'-xanthene)-2'-ylamino)phenyl) propane | 20 |
| 10% Polyvinyl alcohol solution | 10 |
| Water | 70 |

The above-described composition was pulverized with a paint shaker to an average particle diameter of about 1 $\mu$m.

(2) Preparation of Dispersion B:

| Component | Amount (parts) |
|---|---|
| 4,4-bis(p-Toluenesulfonylamino-carbonylamino)di-phenyl-methane (Mdd = 1.0) | 10 |
| 10% Polyvinyl alcohol solution | 10 |
| Water | 80 |

The above-described composition was pulverized with a paint shaker to an average particle diameter of not larger than 1 $\mu$m.

(3) Preparation of Dispersion C:

| Component | Amount (parts) |
|---|---|
| Di-p-methylbenzyl oxalate (Log P = 3.9) | 30 |
| 10% Polyvinyl alcohol solution | 10 |
| Water | 60 |

The above-described composition was pulverized with a paint shaker to an average particle article diameter of not larger than 1 $\mu$m.

(4) Preparation of Dispersion D:

| Component | Amount (parts) |
|---|---|
| Compound of formula (I) | 29.7 |
| 30% Polyvinyl alcohol solution | 1.5 |
| 10% Methyl cellulose solution | 4.8 |
| 20% Polystar SM 1020K (a dispersant of Nippon Oils & Fats Co., Ltd.) | 12 |
| Water | 52 |

The above-described composition was pulverized with a paint shaker to an average particle diameter of not larger than 2 $\mu$m.

(5) Preparation of Subbing Layer:

33 parts of the dispersion D and 20 parts of the dispersion C prepared as described above were mixed with 40 parts of 10% aqueous solution of oxidized starch. The coating liquid thus obtained was applied to a raw paper sheet so that the amount of the coating after drying would be 5.7 g/m$^2$ to obtain a support having the subbing layer.

(6) Formation of Thermosensitive Recording Paper:

A coating liquid was obtained by mixing 60 parts of the dispersion A, 240 parts of the dispersion B, 60 parts of the dispersion C, 40 parts of 40% aluminum hydroxide (trade name: Higilite H-42; a product of Showa Kei-Kinzoku ) dispersion, 30 parts of 30% silica (trade name: Mizukasil P-603; a product of Mizusawa Industrial Chemicals Ltd.) dispersion, 16 parts of 25% zinc stearate dispersion, 27 parts of 30% paraffin dispersion and 90 parts of 10% aqueous polyvinyl alcohol solution under stirring. The coating liquid thus obtained was applied to the subbing layer on the support so that the amount of the coating after drying would be 8.0 g/m$^2$ to form a thermosensitive color image-forming layer, and thereby to obtain a thermosensitive recording paper.

(7) Treatment with Super Calender:

The thermosensitive recording paper obtained as described above was treated with a super calender to control the Bekk smoothness of the surface thereof at 1,000 to 2,500 seconds.

(8) Printing Test:

The sample thus obtained was printed with a color tester (THPMD; a product of Ohkura Electric Co., Ltd.) under conditions comprising a printing voltage of 21.7 V and printing pulse of 1.0 ms. The density of the printed parts was determined with a Macbeth Reflection Color Density Tester RD-914 (a product of Macbeth). The density thus determined will be referred to as "initial density".

(9) Fixing Test:

To determine the re-coloring of the unprinted parts after the heat treatment, the printed sample obtained in (8) was fixed.

(Fixing treatment A) The support side of the sheet obtained as described above was heated at 105° C. under a pressure of 1 g/cm$^2$ for 5 seconds with a heat gradient tester (a product of Toyo Seiki Co., Ltd.). Then the density of the printed part and that of the unprinted part (hereinafter referred to as "densities after the fixing treatment") were determined with Macbeth Reflection Density Tester RD-914. The test results are shown in Table 1.

(Reheating test) The thermosensitive color image-forming layer side of the sheet was heated at 170° C. under a pressure of 1 g/cm$^2$ for 5 seconds with the heat gradient, tester (the product of Toyo Seiki Co., Ltd.). Then, the density of the printed part and that of the unprinted part (hereinafter referred to as "densities after the reheating test") were determined with Macbeth Reflection Density Tester RD-914. The test results are shown in Table 1.

EXAMPLE 2

A thermosensitive recording material was prepared in the same manner as that of Example 1 except that fixing treatment A was replaced by the following fixing treatment B:

(Fixing treatment B) The thermosensitive color image-forming layer side of the sheet obtained as described above was heated at 105° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 3

A thermosensitive recording material was prepared in the same manner as that of Example 1 except that fixing treatment A was replaced by the following fixing treatment C:

(Fixing treatment C) Both the support side and the thermosensitive color image-forming layer side of the sheet were heated at 105° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 4

A thermosensitive recording material was prepared in the same manner as that of Example 1 except that 4,4'-bis(p-toluenesulfonylaminocarbonylamino)diphenylmethane used for the preparation of the dispersion B was replaced with 3,4'-bis(p-toluenesulfonylaminocarbonylamino)diphenyl ether (Mdd=1.0). The test results are shown in Table 1.

EXAMPLE 5

A thermosensitive recording material was prepared in the same manner as that of Example 4 except that fixing treatment A was replaced by the following fixing treatment B:

(Fixing treatment B) The thermosensitive color image-forming layer side of the sheet obtained as described above was heated at 105° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 6

A thermosensitive recording material was prepared in the same manner as that of Example 4 except that fixing treatment A was replaced by the following fixing treatment C:

(Fixing treatment C) Both the support side and the thermosensitive color image-forming layer side of the sheet were heated at 105° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 7

A thermosensitive recording material was prepared in the same manner as that of Example 1 except that 2,2-bis(4-(6'-(N-cyclohexyl-N-methyl amino)-3'-methyl spiro(phthalido-3,9'-xanthene)-2'-ylamino)-phenyl)propane was replaced with 3-di(n-butyl)amino-6-methyl-7-anilinofluoran. The test results are shown in Table 1.

EXAMPLE 8

Thermosensitive recording paper sheets were prepared by a process which will be described below.

(10) Preparation of Dispersion E:

| Component | Amount (parts) |
|---|---|
| 1,2-Bis(3,4-dimethylphenyl)ethane (Log P = 7.8) | 30 |
| 10% Polyvinyl alcohol solution | 15 |
| Water | 55 |

The above-described composition was pulverized with a paint shaker to an average particle diameter of not larger than 2 $\mu$m.

A thermosensitive recording material was prepared in the same manner as that of Example 1 except that the dispersion C used for forming the subbing layer (5) was replaced with the above-described dispersion E and that fixing treatment was conducted according to the following method:

(Fixing treatment A) The support side of the sheet obtained as described above was heated at 95° C. under a pressure of 1 g/cm$^2$ for 5 seconds with the heat gradient tester (a product of Toyo Seiki Co., Ltd.). Then, the density of the printed part and that of the unprinted part (hereinafter referred to as "densities after the fixing treatment") were determined with Macbeth Reflection Density Tester RD-914. The test results are shown in Table 1.

EXAMPLE 9

A thermosensitive recording material was prepared in the same manner as that of Example 8 except that fixing treatment A was replaced by the following fixing treatment B:

(Fixing treatment B) The thermosensitive color image-forming layer side of the sheet obtained as described above was heated at 90° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-914.

In the printing test (8), a head smudge test was also carried out, wherein the quantity of the head smudge on the thermal head was macroscopically determined in the step of recording on the prepared thermosensitive recording material.

The results were classified as follows:

○: no smudge was formed.

Δ: smudge was formed only slightly and caused no practical trouble.

X: smudge adhered to the head.

The test results are shown in Table 1.

EXAMPLE 10

A thermosensitive recording material was prepared in the same manner as that of Example 8 except that fixing treatment A was replaced by the following fixing treatment C:

(Fixing treatment C) Both the support side and the thermosensitive color image-forming layer side of the sheet were heated at 90° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-914. The head smudge test was, also conducted -in the printing test (8). The test results are shown in Table 1.

EXAMPLE 11

A thermosensitive recording material was prepared in the same manner as that of Example 8 except that the heating temperature in the reheating test was changed from 170° C. to 190° C. The test results are shown in Table 1.

EXAMPLE 12

A thermosensitive recording material was prepared in the same manner as that of Example 8 except that 1,2-bis(3,4-dimethylphenyl)ethane (Log P=7.8) used for the preparation of dispersion E was replaced with m-terphenyl (Log P=6.16). The test results are shown in Table 1.

EXAMPLE 13

A thermosensitive recording material was prepared in the same manner as that of Example 8 except that di-p-methylbenzyl oxalate (Log P=3.9) used for the preparation of dispersion C for forming the thermosensitive color image-forming layer (5) was replaced with bis(2-(4-methoxyphenoxy)ethyl ether (Log P=2.9). The test results are shown in Table 1.

EXAMPLE 14

A thermosensitive recording material was prepared in the same manner as that of Example 8. Then, a protective layer was formed on the thermosensitive color image-forming layer thereof as will be described below.

(11) Formation of Protective Layer:

A coating liquid was prepared by mixing, under stirring, 86 parts of 70% clay dispersion (trade name: HG Clay, a product of Huber) containing 0.2%, based on solids, of an anionic surfactant, 10 parts of 25% zinc stearate dispersion, 168 parts of 22% aqueous polyvinyl alcohol solution and 0.5 part of a wetting agent (trade name: Dupro U-99; a product of SAN-NOPCO K.K.). The coating liquid was applied to the thermosensitive color image-forming layer in such a manner that the amount of the coating after drying would be 2 to 3 g/m$^2$ to form the protective layer and thereby to form a thermosensitive recording paper.

The same procedure as that of Example 1 (7) to (9) was repeated except that the heating temperature in the fixing treatment A in the fixing test (9) was altered to 97° C. The test results are shown in Table 1.

EXAMPLE 15

A thermosensitive recording material was prepared in the same manner as that of Example 1, and a protective layer was formed thereon in the same manner as in above step (11).

The same procedure as in (7) to (9) in Example 1 was repeated. The test results are shown in Table 1.

EXAMPLE 16

A thermosensitive recording material was prepared in the same manner as that of Example 15 except that the reheating test was conducted without the fixing treatment. The test results are shown in Table 1.

EXAMPLE 17

A thermosensitive recording material was prepared in the same manner as that of Example 1 except that 40 parts of 10% aqueous starch oxide solution was replaced with 10 parts of 10% aqueous starch oxide solution and 30 parts of 10% SBR latex solution in the preparation of subbing layer (5).

A protective layer was formed on the thermosensitive color image-forming layer in the same manner as in above step (11) in Example 14 except that the pigment HG clay dispersant was replaced with a dispersion of aluminum hydroxide (trade name: Higilite H-42; a product of Showa Kei-Kinzoku) and silica (trade name: Mizukasil P-603; a product of Mizusawa Industrial Chemicals Ltd.) in a ratio of 1:1. After the application of the dispersion in such an amount that the amount after drying would be 2.3 g/m$^2$ to the thermosensitive color image-forming layer, followed by the drying, the thermosensitive recording paper having the protective layer was obtained.

The same procedure as in (7) to (9) in Example 1 was repeated except that the heating temperature in the fixing treatment A in the fixing test (9) was altered to 100° C. The test results are shown in Table 1.

EXAMPLE 18

A thermosensitive recording material was prepared in the same manner as that of Example 17 except that the reheating test was conducted without the fixing treatment. The test results are shown in Table 1.

EXAMPLE 19

A thermosensitive recording material was prepared in the same manner as that of Example 1 except that the reheating test was conducted without the fixing treatment. The test results are shown in Table 1.

EXAMPLE 20

Thermosensitive recording paper sheets were prepared by a process which will be described below.

(12) Preparation of Dispersion F:

| Component | Amount (parts) |
|---|---|
| Compound of formula (II) | 20 |
| 30% Haricoat B 1680 C (a product of Harima Chemicals, Inc.) solution | 13 |
| Water | 66 |

The above-described composition was pulverized with a paint shaker to an average particle article diameter of not larger than 5 μm.

(13) Preparation of Dispersion G:

| Component | Amount (parts) |
|---|---|
| Compound of chemical formula (I) | 20 |
| 30% Haricoat B 1680 (a product of Harima Chemicals, Inc.) solution | 12 |
| 20% Polymaron 326 (a product of Arakawa Kagaku) solution | 1.8 |
| Water | 46.2 |

The above-described composition was pulverized with a paint shaker to an average particle article diameter of not larger than 5 μm.

(14) Preparation of Subbing Layer:

200 parts of the dispersion F, 40 parts of dispersion G and 133 parts of the dispersion E prepared as described above were mixed with 100 parts of 10% aqueous Poval solution. The coating liquid thus obtained was applied to a raw paper sheet so that the amount of the coating after drying would be 5.0 g/m$^2$ to obtain a support having the subbing layer.

(15) Formation of Intermediate Layer

A dispersion was prepared by stirring 63 parts of calcined kaolin (Ansilex 93, a product of Engelhard Corporation having an oil absorption of 90 ml/100 g as determined according to JIS K 5101), 18 parts of a kaolin powder (trade name: Kaofine, a product of Thiele Kaolin having an oil absorption of 40 to 50 ml/100 g), 0.5 part of 40% Poise 520 (a surfactant) and 107 parts of water with Auto homo mixer. The dispersion was stirred together with 110 parts of 11% aqueous starch oxide solution to obtain a coating liquid. The coating liquid was applied to the subbing layer on the support so that the amount thereof after drying would be 2.0 g/m$^2$ and dried to obtain a thermosensitive recording paper having the intermediate layer.

(16) Formation of Thermosensitive Color Image-Forming Layer:

A coating liquid was obtained by mixing 60 parts of the dispersion A, 240 parts of the dispersion B, 60 parts of the dispersion C, 40 parts of 40% aluminum hydroxide (trade name: Higilite H-42; a product of Showa Kei-Kinzoku) dispersion, 30 parts of 30% silica (trade name: Mizukasil P-603; a product of Mizusawa Industrial Chemicals Ltd.) dispersion, 16 parts of 25% zinc stearate dispersion, 27 parts of 30% paraffin dispersion and 90 parts of 10% aqueous polyvinyl alcohol solution under stirring. The coating liquid thus obtained was applied to the intermediate layer of the support having both subbing layer and intermediate layer so that the amount of the coating after drying would be 8.0 g/m$^2$ to form a thermosensitive color image-forming layer, and thereby to obtain a thermosensitive recording paper.

(17) Printing Test and Head Smudge Test:

The sample thus obtained was printed with a coloring tester (THPMD; a product of Ohkura Electric Co., Ltd.) under conditions comprising a printing voltage of 21.7 V and printing pulse of 1.0 ms. The density of the printed parts was determined with a Macbeth Reflection Density Tester RD-914 (a product of Macbeth). The density thus determined will be referred to as "initial density".

In this step, the head smudge test was also carried out.

The quantity of the head smudge on the thermal head was macroscopically determined in the step of recording on the prepared thermosensitive recording material.

The results were classified as follows:

○: no smudge was formed.

Δ: smudge was formed only slightly and caused no practical trouble.

X: smudge adhered to the head.

(18) Fixing Test:

To determine the re-coloring of the unprinted parts after the heat treatment, the printed sample obtained in (17) was fixed.

(Fixing treatment D) The support side of the sheet obtained as described above was heated at 98° C. under a pressure of 1 g/cm$^2$ for 5 seconds with the heat gradient tester (a product of Toyo Seiki Co., Ltd.). Then, the density of the printed part and that of the unprinted part ("densities after the fixing treatment") were determined with Macbeth Reflection Density Tester RD-914. The test results are shown in Table 1.

(Reheating test) The thermosensitive color image-forming layer side of the sheet was heated at 170° C. under a pressure of 1 g/cm$^2$ for 5 seconds with the heat gradient tester (the product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 21

A thermosensitive recording material was prepared in the same manner as that of Example 20 except that fixing treatment D was replaced by the following fixing treatment E:

(Fixing treatment E) The thermosensitive color image-forming layer side of the sheet obtained as described above was heated at 95° C. under a pressure of 1 g/cm$^2$ for 5 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 22

A thermosensitive recording material was prepared in the same manner as that of Example 20 except that fixing treatment D was replaced by the following fixing treatment F:

(Fixing treatment F) Both support side and thermosensitive color image-forming layer side of the sheet obtained as described above were heated at 90° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-9 14. The test results are shown in Table 1.

EXAMPLE 23

A thermosensitive recording material was prepared in the same manner as that of Example 20 except that, in the formation of the subbing layer (14), a coating liquid obtained by mixing 27 parts of the dispersion E, 20 parts of 10% aqueous Poval solution and 33 parts of dispersion D in place of dispersions F and G was applied to a raw paper sheet so that the amount of the coating after drying would be 5.0 g/m$^2$ to obtain a support having the subbing layer. The test results are shown in Table 1.

EXAMPLE 24

A thermosensitive recording material was prepared in the same manner as that of Example 23 except that fixing treatment D was replaced by the following fixing treatment E:

(Fixing treatment E) The thermosensitive color image-forming layer side of the sheet obtained as described above was heated at 90° C. under a pressure of 1 g/cm$^2$ for 5 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 25

A thermosensitive recording material was prepared in the same manner as that of Example 23 except that fixing treatment D was replaced-by the following fixing treatment F:

(Fixing treatment F) Both support side and thermosensitive color image-forming layer side of the sheet obtained as described above were heated at 90° C. under a pressure of 1 g/cm$^2$ for 3 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 26

A thermosensitive recording material was prepared in the same manner as that of Example 23 except that di-p-methylbenzyl oxalate (log P=3.9) was replaced with bis(2-

(4-methoxyphenoxy)ethyl) ether (log P=2.9) in the preparation of dispersion C. The test results are shown in Table 1.

EXAMPLE 27

A thermosensitive recording material was prepared in the same manner as that of Example 23 except that the compound of chemical formula (I) was replaced with the compound of formula (IV) in the preparation of dispersion D. The test results are shown in Table 1.

EXAMPLE 28

A thermosensitive recording material was prepared in the same manner as that of Example 23. Then, a protective layer for imparting the printability was formed on the thermosensitive color image-forming layer thereof as will be described below.

(19) Formation of Protective Layer:

A coating liquid was obtained by mixing, under stirring, 86 parts of 70% clay dispersion (trade name: ULTRA WHITE 90, a product of Engelhard Corporation) containing 0.2%, based on solids, of an anionic surfactant, 10 parts of 25% zinc stearate dispersion, 168 parts of 22% aqueous polyvinyl alcohol solution and 0.5 part of a 3% aqueous solution of the wetting agent (trade name: Dupro U-99; a product of SAN-NOPCO K.K.). The coating liquid was applied to the thermosensitive color image-forming layer in such a manner that the amount of the coating after drying would be 1 to 2 g/m$^2$ to form the protective layer and thereby to form a thermosensitive recording paper.

The same procedure as that of Example 1 (7) to (9) was repeated. The test results are shown in Table 1.

EXAMPLE 29

A thermosensitive recording material was prepared in the same manner as that of Example 28 except that di-p-methylbenzyl oxalate was replaced with bis(2-(4-methooxyphenoxy)ethyl) ether in the preparation of dispersion C for the formation of the thermosensitive color image-forming layer. The reheating test was carried out without the fixing treatment. The test results are shown in Table 1.

EXAMPLE 30

A thermosensitive recording material was prepared in the same manner as that of Example 20. Then, a protective layer for imparting the printability was formed on the thermosensitive color image-forming layer thereof as described in process (19). For the fixing, the following fixing treatment G was carried out:

(Fixing treatment G) The thermosensitive color image-forming layer side of the sheet obtained as described above was heated at 95° C. under a pressure of 1 g/cm$^2$ for 5 seconds with the heat gradient tester (a product of Toyo Seiki Co., Ltd.). Then, the density of the printed part and that of the unprinted part ("densities after the reheating test") were determined with Macbeth Reflection Density Tester RD-914. The test results are shown in Table 1.

EXAMPLE 31

A thermosensitive recording material was prepared and then tested in the same manner as that of Example 30 except that in the formation of the thermosensitive color image-forming layer (16), 40 parts of 40% aluminum hydroxide (trade name: Higilite H-42; a product of Showa Kei-Kinzoku) dispersion and 30 parts of 30% silica (trade name: Mizukasil P-603; a product of Mizusawa Industrial Chemicals Ltd.) dispersion used as the pigments were replaced with 96 parts of 26% aluminum silicate (trade name: Pasilex P-820A, a product of Degussa) dispersion, and that 0.4 part of 40% aqueous glyoxal solution was added as a crosslinking agent in the formation of the protective layer (19). The test results are shown in Table 1.

COMPARATIVE EXAMPLE 1

The same procedure as that of Example 1 was repeated except that 4,4'-bis(p-toluenesulfonylaminocarbonylamino) diphenylmethane used for the preparation of dispersion B was replaced with 2,2-bis(4-hydroxyphenyl)propane (bisphenol A) (Mdd=0.1). The test results are shown in Table 1.

COMPARATIVE EXAMPLE 2

The same procedure as that of Example 1 was repeated except that the subbing layer was not prepared, and the thermosensitive color image-forming layer was directly formed on the paper. The test results are shown-in Table 1.

COMPARATIVE EXAMPLE 3

The same sample as that of Comparative Example 2 was used, but the reheating test was conducted without the fixing treatment. The test results are shown in Table 1.

EXAMPLE 32

Example 20 was repeated except that 2,4-bis(phenyl sulfonyl)phenol was used (Mds=0.6), in place of 4,4'-bis(p-toluenesulfonyl aminocarbonylamino)diphenyl methane used for the preparation of dispersion B.

EXAMPLE 33

Example 20 was repeated except that a mixture (Mdd=0.9) of 1,7-(1,4,7-trioxyhepten) bis(4-(p-hydroxyphenyl sulfonyl) benzene) and 4,4'-bis(7-(4-(p-hydroxyphenyl sulfonyl)phenyl-1,4,7-trioxyhept-1-yl) diphenylsulfone (82 to 18) was used in place of 4,4'-bis(p-toluenesulfonyl aminocarbonylamino)diphenyl methane used for the preparation of dispersion B.

EXAMPLE 34

Example 20 was repeated except that 4-(2-(p-methoxyphenyloxy)ethyloxy)salicylic acid (Mdd=0.5) was used in place of 4,4'-bis(p-toluenesulfonyl aminocarbonylamino)diphenyl methane used for the preparation of dispersion B and that Fixing treatment B was used in place of Fixing treatment A.

TABLE 1

| | Initial | Density after fixing (D) | | Density after re-heating test (D) | | |
|---|---|---|---|---|---|---|
| | density (D) | Printed part | Unprinted part | Printed part | Unprinted part | Smudge |
| Ex. 1 | 1.37 | 1.37 | 0.10 | 1.15 | 0.38 | — |
| Ex. 2 | 1.38 | 1.37 | 0.10 | 1.12 | 0.35 | — |
| Ex. 3 | 1.37 | 1.36 | 0.10 | 1.12 | 0.36 | — |
| Ex. 4 | 1.35 | 1.34 | 0.10 | 1.11 | 0.38 | — |
| Ex. 5 | 1.35 | 1.32 | 0.10 | 1.10 | 0.38 | — |
| Ex. 6 | 1.34 | 1.32 | 0.10 | 1.11 | 0.38 | — |
| Ex. 7 | 1.28 | 1.28 | 0.07 | 1.05 | 0.40 | — |
| Ex. 8 | 1.33 | 1.36 | 0.07 | 1.13 | 0.35 | — |
| Ex. 9 | 1.35 | 1.36 | 0.06 | 1.05 | 0.35 | Δ |
| Ex. 10 | 1.35 | 1.35 | 0.06 | 1.12 | 0.36 | Δ |
| Ex. 11 | 1.33 | 1.34 | 0.08 | 0.83 | 0.50 | — |
| Ex. 12 | 1.32 | 1.25 | 0.06 | 1.10 | 0.26 | — |
| Ex. 13 | 1.34 | 1.32 | 0.10 | 1.11 | 0.38 | — |

TABLE 1-continued

| | Initial density (D) | Density after fixing (D) Printed part | Density after fixing (D) Unprinted part | Density after re-heating test (D) Printed part | Density after re-heating test (D) Unprinted part | Smudge |
|---|---|---|---|---|---|---|
| Ex. 14 | 1.33 | 1.27 | 0.12 | 1.10 | 0.30 | — |
| Ex. 15 | 1.33 | 1.27 | 0.12 | 1.00 | 0.30 | — |
| Ex. 16 | 1.33 | — | — | 1.00 | 0.45 | — |
| Ex. 17 | 1.10 | 1.10 | 0.09 | 0.80 | 0.30 | — |
| Ex. 18 | 1.10 | — | — | 0.70 | 0.33 | — |
| Ex. 19 | 1.38 | — | — | 1.13 | 0.50 | — |
| Ex. 20 | 1.40 | 1.38 | 0.09 | 1.10 | 0.48 | ○ |
| Ex. 21 | 1.41 | 1.38 | 0.09 | 1.15 | 0.42 | ○ |
| Ex. 22 | 1.40 | 1.39 | 0.09 | 1.02 | 0.42 | ○ |
| Ex. 23 | 1.43 | 1.43 | 0.07 | 1.14 | 0.35 | ○ |
| Ex. 24 | 1.43 | 1.44 | 0.09 | 1.13 | 0.35 | ○ |
| Ex. 25 | 1.43 | 1.45 | 0.08 | 1.13 | 0.36 | ○ |
| Ex. 26 | 1.35 | 1.32 | 0.05 | 1.16 | 0.38 | ○ |
| Ex. 27 | 1.34 | 1.32 | 0.05 | 1.16 | 0.36 | ○ |
| Ex. 28 | 1.40 | 1.32 | 0.06 | 1.01 | 0.54 | ○ |
| Ex. 29 | 1.43 | 1.43 | 0.07 | 1.10 | 0.59 | ○ |
| Ex. 30 | 1.40 | 1.39 | 0.09 | 1.22 | 0.51 | ○ |
| Ex. 31 | 1.40 | 1.39 | 0.09 | 1.16 | 0.56 | ○ |
| Comp. Ex. 1 | 1.36 | 1.35 | 0.70 | 1.00 | 1.23 | Δ |
| Comp. Ex. 2 | 1.34 | 1.32 | 0.34 | 1.48 | 1.37 | × |
| Comp. Ex. 3 | 1.34 | — | — | 1.48 | 1.41 | × |
| Ex. 32 | 1.20 | 1.17 | 0.08 | 0.83 | 0.37 | — |
| Ex. 33 | 1.22 | 1.17 | 0.09 | 0.79 | 0.37 | — |
| Ex. 34 | 1.30 | 1.30 | 0.10 | 1.00 | 0.54 | — |

It is apparent from the results shown in Table 1 that in Examples 1 to 15 and 17 and 32 to 34 [wherein the thermosensitive recording material comprising, on the sheet substrate, a thermosensitive color image-forming layer, containing the dye precursor and the specific color-developer and a subbing layer containing the specific color developability reducing substance was fixed by heating the support side, thermosensitive color image-forming layer side or both sides of the sheet], the density of the unprinted parts after the reheating was 0.55 D or below and the fixing properties were excellent. On the contrary, in Comparative Example 1 wherein the comparative phenolic compound was used as the color developer, the colors tended to be faded and the unprinted parts were also colored and not fixed because the legibility in the unprinted parts was poor. It is understood from Comparative Example 2 that when the layer containing the ester compound and basic compound was not formed, the whole surface of the recording material was colored by the reheating and the printed image could not be recognized.

In Examples 16, 18 and 19, even when the thermosensitive recording materials of the present invention were not fixed, the fixing treatment was conducted in the course of the reheating test to such an extent that the printed images could be recognized even though the printed images were not as clear as in Examples 1 to 15 and 17 wherein the fixing treatment was conducted. On the other hand, in Comparative Example 3 wherein the layer containing the ester compound and basic compound is not formed, the whole surface of the material was colored, by the heating, and the image could not be recognized.

Thus, the thermosensitive recording materials of the present invention have excellent fixing properties. It is understood that the thermosensitive recording material can be easily fixed by the thermal fixing method of the present invention.

In Examples 8 to 14, the contrast was clear because the printed images remain well after the reheating (even when the reheating was conducted at a very high temperature as in Example 11), and the fixing was excellent. Therefore, the hydrophobic parameter of the second heat-fusible substance in the subbing layer is preferably higher than that of the first heat-fusible substance in the thermosensitive color image-forming layer.

In Examples 20 to 29, the formation of smudge on the head in the heat printing was inhibited when the thermosensitive recording material has the intermediate layer. When the thermosensitive recording material was fixed (by heating the support side, coloring side or both sides of the sheet), the density of the unprinted part after the reheating was 0.6 D or below, the contrast of the printed part to the unprinted part was sharp, and the fixing was excellent. On the other hand, the fixing was impossible when the comparative phenolic compound was used as the color developer or when the layer containing the ester compound and the basic compound was not formed.

Thus, the formation of the intermediate layer is preferred for inhibiting the formation of the head smudge in the record printing step and for realizing the excellent fixing properties.

Thus, the thermosensitive recording materials of the present invention have excellent fixing properties, and the thermosensitive records can be easily heat-fixed by the fixing method of the present invention.

What is claimed is:

1. A heat fixable thermosensitive recording material comprising, a subbing layer and a thermosensitive color image-forming layer in this order on a sheet substrate, said thermosensitive color image-forming layer comprising (a) a colorless or light-colored dye precursor and (b) a color-developer which reacts with said dye precursor to color said precursor when said thermosensitive color image-forming layer is heated, said color-developer being selected such that the color image has a high solvent resistance after the coloring, and said subbing layer comprising a color developability reducing substance capable of reducing the color-developing function of said color-developer and which does not reduce the printed image density in the thermosensitively printed part and having a melting point of 40° C. or higher.

2. The thermosensitive recording material of claim 1 wherein said color-developer has a group selected from the group consisting of the following:

(1) a sulfonylurea group (—$SO_2$NHCONH—);

(2) a sulfonamide group (—$SO_2$NH—);

(3) a urea group (—NHCONH—) or a thiourea group (—NHCSNH—);

(4) a combination of a phenol group and a heteroatom other than oxygen;

(5) a salicylic acid group or its metal salt, and (6) a phenol group, provided that said color developer has a molecular weight of 1000 or higher, and mixtures thereof.

3. The thermosensitive recording material of claim 1 wherein said color-developer has at least two sulfonylurea groups in a molecule.

4. The thermosensitive recording material of claim 3, wherein said color developer is 4,4'-bis(p-toluenesulfonylaminocarbonylamino)diphenylmethane.

5. The thermosensitive recording material of claim 1 wherein said color developer is contained in said thermosensitive color image-forming layer in an amount of 5 to 50 wt. % based on the dry weight of said thermosensitive color-image forming layer.

6. The thermosensitive recording material of claim 1, wherein said color developability reducing substance is selected from the group consisting of aliphatic esters, aromatic esters and basic compounds.

7. The thermosensitive recording material of claim 6, wherein said basic compound are selected from the group consisting of the compounds having the following formulae (I) (II) and (IV):

(I)

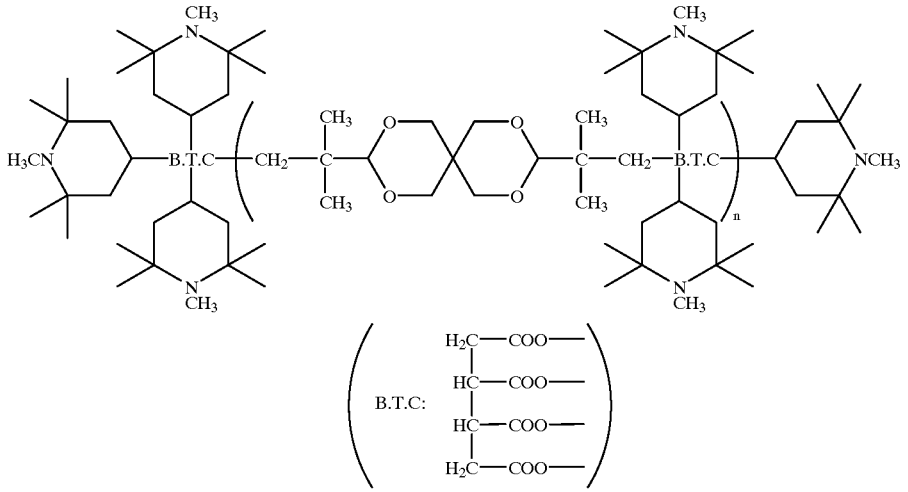

(II)

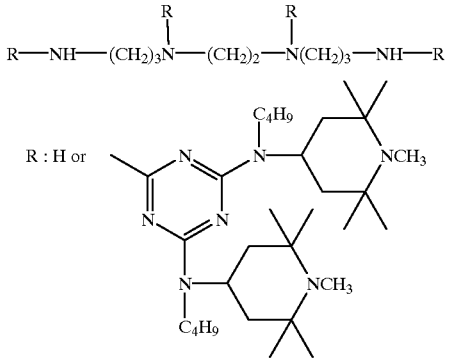

(IV)

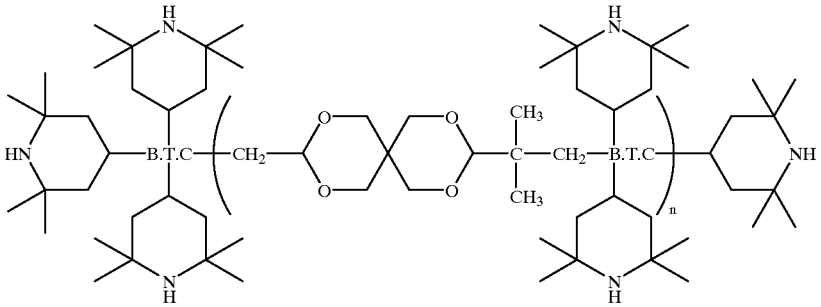

wherein the MW≧2000; and mixtures thereof.

8. The thermosensitive recording material of claim 6, wherein said basic compounds are hindered amine compounds or compounds having N-methylpiperidine groups and tertiary amine groups, and mixtures thereof.

9. The thermosensitive recording material of claim 1, wherein said developability reducing substance is contained in said subbing layer in an amount of 0.5 to 5 parts by weight per one part by weight of said color developer.

10. The thermosensitive recording material of claim 1, wherein said dye precursor is 2,2-bis(4-(6'-(N-cyclohexyl-N-methylamino)-3'-methylspiro(phthalido-3,9'-xanthene)-2'-ylamino)phenyl)propane.

11. The thermosensitive recording material of claim 1, wherein said dye precursor is contained in said thermosensitive color image-forming layer in an amount of 5 to 40 wt. % based on the dry weight of said thermosensitive color image-forming layer.

12. The thermosensitive recording material of claim 1, wherein said thermosensitive color image-forming layer further contains a first heat-fusible substance.

13. The thermosensitive recording material of claim 12, wherein said first heat fusible substance is selected from the group consisting of phenyl 1-hydroxy-2-naphthoate, benzyl naphthyl ether, dibenzyl terephthalate, benzyl p-benzyloxybenzoate, diphenyl carbonate, ditolyl carbonate, 1,2-diphenoxyethane, 1,2-bis(m-tolyloxy)ethane, 1,5-bis(p-methoxyphenoxy)-3-oxapentane, bis(2-(4-methoxyphenoxy)ethyl) ether, dibenzyl oxalate, di-p-methylbenzyl oxalate, a mixture of di-p-methylbenzyl oxalate and di-p-chloromethylbenzyl oxalate, 1,4-bis (tolyloxy)benzene, phenyl-p-toluenesulfonate, p-tolyl mesitylenesulfonate, 4,4'-diallyloxydiphenylsulfone, 4-ethoxyphenylmethyl sulfone, 4,4'-diisopentyloxy diphenyl sulfonate, 4,4'-dimethoxydiphenyl sulfone, (2,2-bis(4-benzene sulfonyloxy phenyl)propane, 2,2-bis(4-methane sulfonyloxy phenyl)propane, N-phenyl-4-methylphenylsulfonamide, o-chloroacetoacetoanilide, p-methoxybenzene acetoacetoanilide, N-benzyl-o-sulfophthalimide and 1-phenoxy-2-β-naphthoxyethane.

14. The thermosensitive recording material of claim 1, wherein said subbing layer further contains a second heat-fusible substance.

15. The thermosensitive recording material of claim 14, wherein log P of said second heat-fusible substance is higher than that of said first heat-fusible substance.

16. The thermosensitive recording material of claim 15, wherein log P of said second heat-fusible substance is higher by 0.5 to 6 than that of said first heat-fusible substance.

17. The thermosensitive recording material of claim 14, wherein said second heat fusible substance is selected from the group consisting of phenyl 1-hydroxy-2-naphthoate, p-benzylbiphenyl, benzyl naphthyl ether, dibenzyl terephthalate, benzyl p-benzyloxybenzoate, diphenyl carbonate, dinitrile carbonate, m-terphenyl, 1,2-bis(m-tolyloxy)ethane, 1,2-bis(3,4-dimethylphenyl)ethane, 1,5-bis (p-methoxyphenoxy)-3-oxapentane, oxalic acid diesters, dibenzyl oxalate, a mixture of di-p-methylbenzyl oxalate and di-p-chloromethylbenzyl oxalate, di-o-chlorobenzyl adipate, 1,4-bis(tolyloxy)benzene, phenyl-p-toluenesulfonate, p-tolyl mesitylenesulfonate, 4,4'-diallyloxydiphenylsulfone, methyl 4-ethoxyphenylmethylsulfone, 4,4'-diisopentyloxydiphenylsulfonate, 2,2-bis(4-benzenesulfonyloxyphenyl)propane, 2,2-bis(4-methanesulfonyloxyphenyl)propane, N-phenyl-4-methylphenylsulfonamide, o-chloroacetoacetoanilide, p-methoxybenzene acetoacetoanilide, N-benzyl-o-sulfophthalimide and 1-phenoxy-2-β-naphthoxyethane.

18. The thermosensitive recording material of claim 1, further comprising an intermediate layer between said subbing layer and said thermosensitive color image-forming layer.

19. The thermosensitive recording material of claim 18, wherein said intermediate layer comprises an oil-absorbing pigment.

20. The thermosensitive recording material of claim 19, wherein said oil-absorbing pigment has an oil-absorption of at least 35 ml/100 g as determined according to JIS K 5101.

21. A method of fixing a thermosensitive recording material, comprising the steps of:

1) recording an image on the thermosensitive recording material of claim 1; and 2) heating the resultant thermosensitive recording material to 40° C. or above.

22. The method of claim 21, wherein said thermosensitive recording material is heated to 50° C. or above for 10 seconds or less.

23. The method of claim 21, wherein the interval from the recording step (1) to the heating step (2) is 10 seconds or less.

24. The thermosensitive recording material of claim 1, wherein said color developability reducing substance has a melting point of 50 to 150° C.

25. The thermosensitive recording material of claim 1, wherein said dye precursor is selected from the group consisting of triphenylmethane compounds, fluoran compounds, diphenylmethane compounds, and mixtures thereof.

* * * * *